United States Patent [19]

Scammell

[11] Patent Number: 4,493,638

[45] Date of Patent: Jan. 15, 1985

[54] POST-AERATED BURNER FOR GROUND FLARE, AND GROUND FLARE INCORPORATING SAME

[75] Inventor: Roger S. Scammell, Yarmouth, England

[73] Assignee: The British Petroleum Company, p.l.c., London, England

[21] Appl. No.: 348,228

[22] Filed: Feb. 12, 1982

[30] Foreign Application Priority Data

Feb. 18, 1981 [GB] United Kingdom ..... 8105121

[51] Int. Cl.[3] ..... F23D 13/20

[52] U.S. Cl. ..... 431/202; 431/171; 431/347; 431/350

[58] Field of Search ..... 431/171, 202, 347, 350; 432/222

[56] References Cited

U.S. PATENT DOCUMENTS

| | | | |
|---|---|---|---|
| 1,654,403 | 12/1927 | Blake | 431/171 |
| 1,801,459 | 4/1931 | Slauter | 239/505 |
| 1,933,790 | 11/1933 | Crone | 431/172 |
| 2,971,605 | 2/1961 | Frost et al. | 431/202 |
| 3,574,507 | 4/1971 | Kydd | 431/350 |
| 3,703,349 | 11/1972 | Straitz | 431/202 |
| 3,779,689 | 12/1973 | Reed et al. | 431/89 |
| 3,836,318 | 9/1974 | Desty et al. | 431/202 |
| 3,859,034 | 1/1975 | Heyde et al. | 431/80 |
| 4,052,142 | 10/1977 | Reed et al. | 431/202 |
| 4,065,248 | 12/1977 | Straitz et al. | 431/202 |
| 4,174,201 | 11/1979 | Straitz | 431/202 |
| 4,269,583 | 5/1981 | Straitz | 431/202 |

FOREIGN PATENT DOCUMENTS

| | | | |
|---|---|---|---|
| 19386 | 11/1980 | European Pat. Off. . | |
| 2119831 | 2/1972 | Fed. Rep. of Germany | 431/354 |
| 1287685 | 9/1972 | United Kingdom | 431/347 |
| 1453302 | 10/1976 | United Kingdom . | |
| 2005821 | 9/1979 | United Kingdom . | |

*Primary Examiner*—Samuel Scott
*Assistant Examiner*—Allen J. Flanigan
*Attorney, Agent, or Firm*—Morgan, Finnegan, Pine Foley & Lee

[57] ABSTRACT

Burner for a concealed flare has a fuel gas supply pipe having a low resistance to upward aspirated air flow. The pipe has outlets directing fuel gas onto adjacent plates which cause spreading and mixing of fuel gas with aspirated air. The angle of fuel gas impingement on the plates is 1° to 55° and the plates have a flame retaining top edge.

17 Claims, 7 Drawing Figures

POST-AERATED BURNER FOR GROUND FLARE, AND GROUND FLARE INCORPORATING SAME

The present invention relates to burners and more particularly to burners used for the disposal of refinery gases or gases from other oil or chemical plant.

Conventional refinery burners comprising a fuel gas feed tube having a number of outlet holes are well known. These burners are of simple construction and relatively straightforward to fabricate. However, they produce relatively long radiative flames with a relatively high smoking tendency caused by relatively poor aerodynamics. Also carbon build up in the feeder tube caused by back radiation and flame lick can cause the feeder tube to split, thereby reducing the burner efficiency or even disabling it until repairs can be effected.

The burners are often used as part of a ground flare. A problem with ground flares is that the chimney requires a refractory or insulating lining to prevent the outer metal wall from becoming too hot. Highly radiative flames give rise to high temperatures and high thermal stresses in the refractory materials which can cause cracking and even eventual failure of the refractory.

The present invention relates to an improved burner suitable for burning refinery or other gas with a relatively shorter and less radiative flame and which has relatively fewer maintenance problems and which is suitable for use in a ground fired flarestack.

Thus according to the present invention there is provided a burner suitable for use in a concealed flare comprising a fuel gas supply pipe having a low resistance to upward air flow, the pipe having one or more outlets, a plate adjacent and at an angle to each outlet whereby the angle of fuel gas impingement on the plat is at an angle of 1° to 55°, means for passing air upwardly past the outlets and plates, and means for retaining the flame resulting from combustion of the fuel gas and air.

The burner of the present invention has certain features differing from the prior art. Thus, (a) the gas supply pipes have low resistance to upward aspirated air flow, (b) the angle of the plate and outlet gas flow gives good spreading and hence mixing of the fuel gas and air giving a less radiative and shorter flame, and (c) the presence of means for flame retention.

The burner preferably has a chimney or the like above it so as to produce a flow of aspirated air from below the burner to mix with the fuel gas. Alternatively, air may be blown through the burner, e.g. using a fan.

The burner may comprise a single fuel gas pipe, but preferably the burner comprises an array of fuel gas pipes, most preferably arranged in parallel rows. The fuel gas pipes have a cross-section giving low aerodynamic resistance in the direction of air flow which reduces local turbulence at the burners and gives rise to better mixing of fuel and air. Preferably this is achieved by use of smooth pipes of greater dimension in the direct of the air flow, e.g. of elliptical section. This is in contrast to typical refinery burners comprising a circular cross-section pipe with fuel gas outlet holes in its upper surface which provides a bluff shape with high resistance to air flow leading to local turbulence and relatively poor mixing.

The plate has associated flame retention means which preferably comprise the upper edge of the plate being turned over in the direction of the fuel gas outlet, most preferably to a horizontal position. The flame retention means reduces the tendency of the flame to lift off by providing a turbulent "anchor" zone of fuel gas and air. The plate itself is preferably flat and is of a size to cause spreading and mixing of the fuel gas with air. The plates are preferably fabricated from stainless steel. The fin plate allows the fuel gas to spread out as a laminar layer across the plate and in combination with the flame retention means gives a stable flame remote from the fuel gas outlets thereby reducing heating of and carbon build-up in the fuel gas supply pipes. The carbon build-up is believed to be cause not by deposition from the flame but by excessively high temperatures of the fuel gas supply tubes giving rise to pyrolysis of the fuel gas.

The fuel gas outlet holes are preferably positioned in the upper surface of the fuel gas supply pipe.. In order to obtain the required angle of impingement of the fuel gas on the plate (a) the fuel gas outlets may be fabricated to angle the fuel gas onto the plate, (b) the fuel gas may emerge vertically from the hole, the plate being angled and close enough to the outlet to give impingement, or a combination of (a) and (b) may be used. The preferred feature is arrangement (b). Another embodiment of the invention has fuel gas outlet holes comprising further pipes projecting from the upper surface of the fuel gas supply pipe, the further pipes having outlet holes directing fuel gas onto the adjacent plate.

The fuel outlet may be circular in shape, but preferably it is shaped so as to assist spreading the fuel gas over the plate and an elliptical outlet is a preferred configuration.

The plate is preferably fixed to the upper surface of the gas supply pipe, most preferably by welding.

The angle of fuel gas impingement on the plate is at an angle of 1° to 55° and in one embodiment the fuel gas flow emerges vertically from the outlet and most preferably the plate is inclined towards the outlet so as to make an angle of up to 10° from the vertical, the preferred range being from 4° to 7°.

In a second embodiment, the fuel gas outlet comprises a pipe projecting from the fuel supply pipe towards a preferably vertical plate, the angle between the emergent fuel gas flow and the plate being preferably 40° to 55°, the most preferred range being 47° to 51°. The preferred dimensions are chosen to give the optimum flame conditions without the angle of fuel gas flow either causing the flame to lift off or to cause unacceptable carbon build-up in the fuel supply pipes.

In a burner comprising a plurality of fuel gas outlet holes and plates, the plates are preferably discrete entities but may be a single long plate across the burner or a linked series of single plates. By use of discrete or single plates, ignition of the burner may be facilitated as turbulence at the upper ends of the edges of the plates tends to promote cross lighting across the burner.

A radiant heat screen, preferably in the form of a triangular cross-section strip of metal, may be positioned above the common fuel supply pipe so as to prevent overheating due to gas recirculation and direct flame impingement.

The burner element as hereinbefore described may be used as part of a ground flare system. Thus, according to a further aspect of the invention, there is provided a ground flare comprising a supply pipe for fuel gas, the supply pipe being connected to a burner as hereinbefore described, and an enclosure having vertical walls, the lower ends of which are above ground level thereby allowing access of air to the burner element within the enclosure.

The internal walls of the flare are preferably metallic and lined with a refractory material, e.g. firebricks, castable or plastic refractory material, ceramic fibre. Preferably a draught or wind fence encloses the base of the flare. The draught fence may be slatted so that air can flow through the fence and then into the flare.

The flare may be lit using conventional ignition procedures.

The invention will now be described by way of example only with reference to FIGS. 1 to 5 of the accompanying drawings.

Figure 4C:
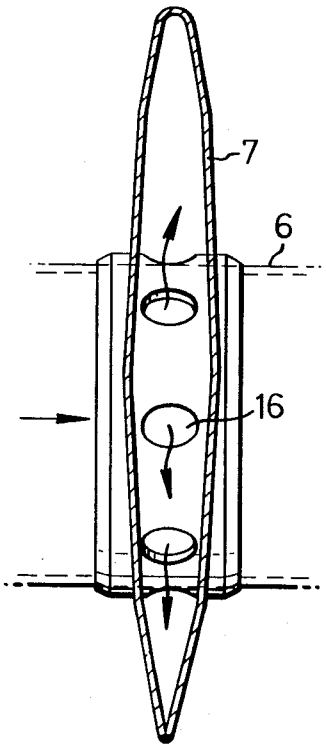
Figure 4B:
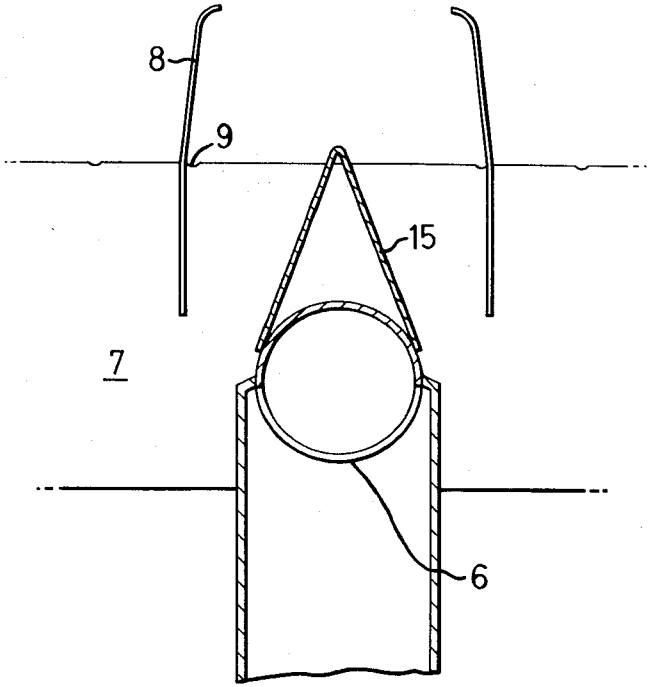
Figure 4A:
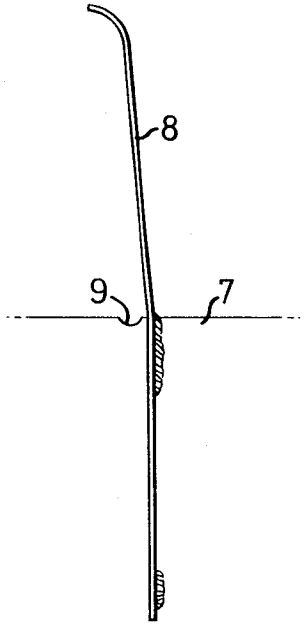
Figure 5:
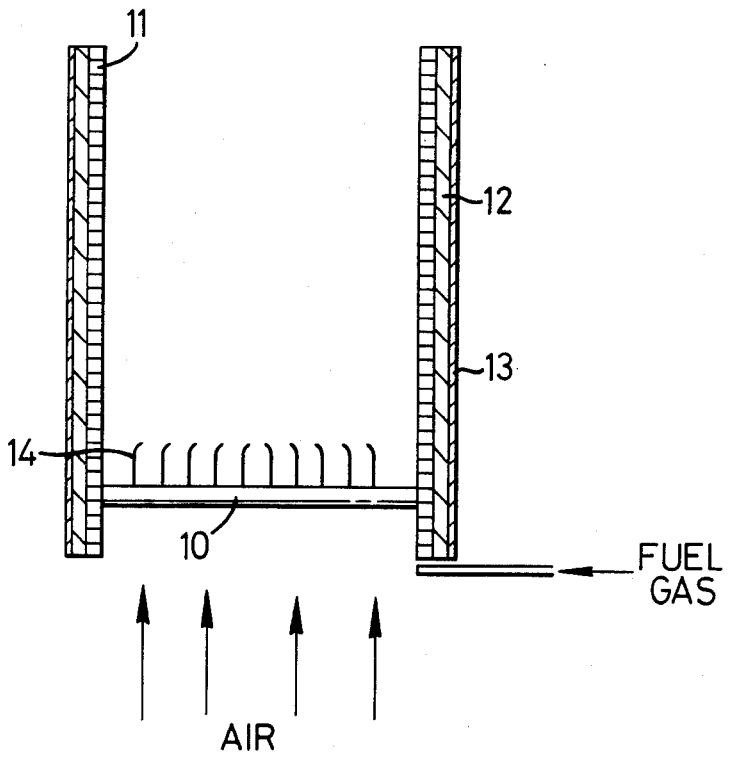

FIGS. 4(*a*), 4(*b*) and 4(*c*) show a side view of a second embodiment of the burner element, a vertical section through the main fuel gas supply line looking towards the secondary fuel gas line and a vertical cross-section of the secondary fuel gas line respectively. FIG. 5 is a schematic view of a ground flare incorporating the burner element.

Figure 2:
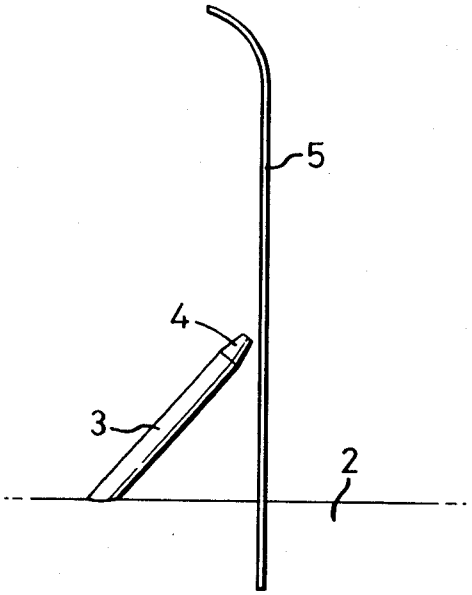
FIGS. 2 is a side view of a single unit of the first embodiment of the burner element.
Figure 1:
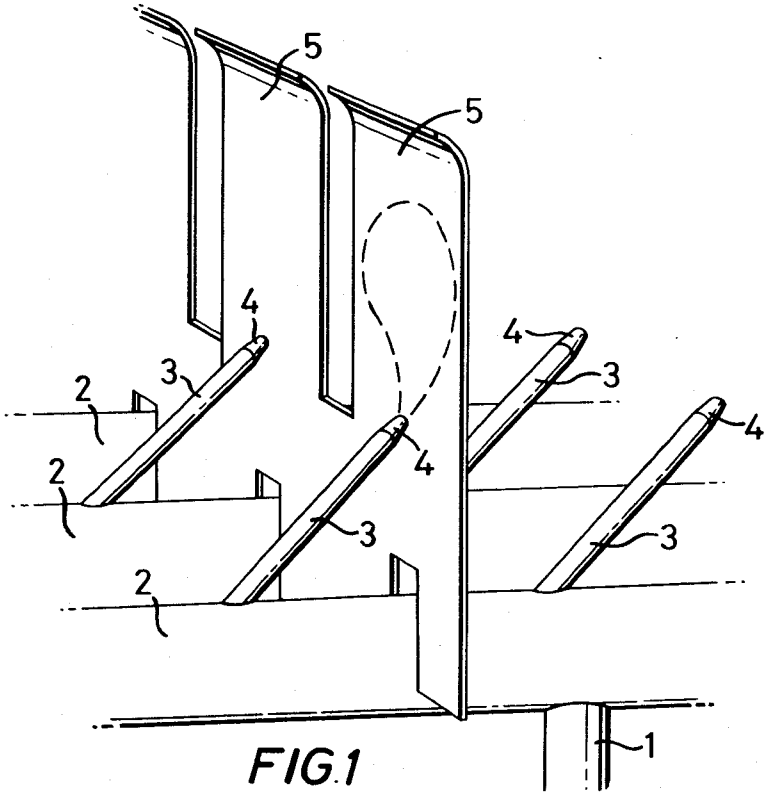
FIGS. 1 and 3 are perspective views of two embodiments of the burner element.

With reference to FIGS. 1 and 2, the burner element comprises a main fuel gas supply line 1 which feeds a plurality of parallel secondary fuel gas lines 2. The secondary lines 2 are fabricated from steel and take the form of narrow vertical flattened tubes having a height of 4.0 cms, maximum width of 1.0 cms and length 50 cms. The tubes present a narrow cross-section and give a low aerodynamic resistance to air flowing upwards between the tubes. At regular distances along the secondary lines 2 are positioned a number of outlet nozzles 3. These outlet nozzles 3 take the form of narrow tubes of hole exit area 12 $mm^2$ in the plane of associated secondary line 2 and angled upwards at about 45°. Each nozzle 3 has a tapered outlet 4. The nozzles 3 may be arranged in pairs pointing towards each other, all pointing in the same direction or any other convenient arrangement. Adjacent to the exit of each outlet nozzle 3 is positioned a flat plate or fin 5. The plate 5 is fixed to the associated secondary line 2 by welding or other suitable means, the plate 5 being set at right angles to the line 2 in the direction towards the outlet nozzle 3.

During use of the burner, fuel gas emerging from the tapered end 4 of the nozzle 3 impinges on plate 5 and spreads over the surface of the plate 5. This allows mixing of atmospheric air (or aspirated air) flowing upwardly between the secondary fuel lines 2 and the fuel gas to provide a combustible mixture which burns at the upper end of the plate 5. This upper end is bent over to assist flame retention of the flame above the plates.

It was found experimentally that the optimum acute angle between the plate and the jet of fuel gas emerging from the outlet nozzle was from 45° to 50°. Although angles greater or less than these values are suitable under certain conditions, the flame becomes more unstable and has a tendency to lift off or, alternatively, some of the fuel gas tends to pass back towards the secondary gas lines causing carbon build-up to occur.

Figure 3:
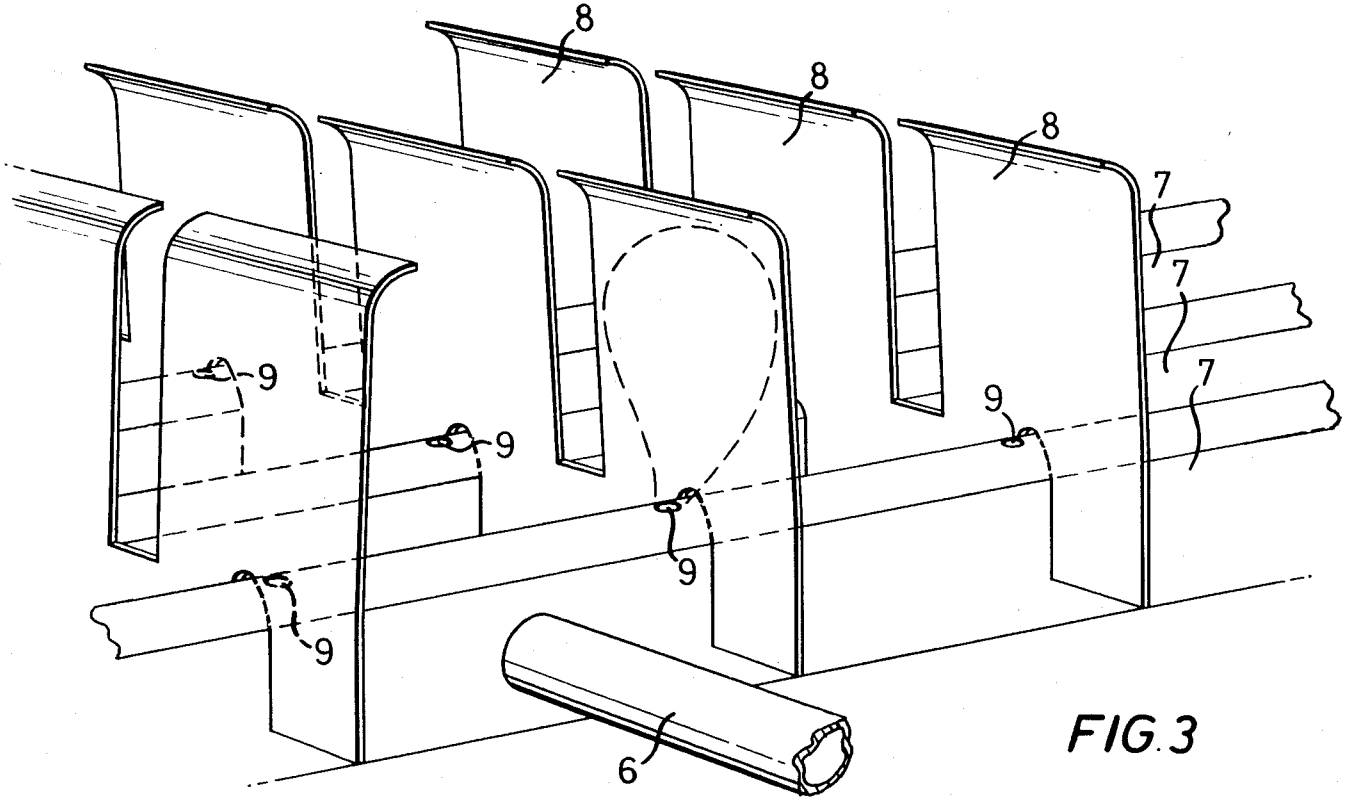

With reference to FIGS. 3 and 4, the burner element comprises a main fuel gas line 6 which feeds a plurality of parallel secondary fuel gas lines 7. The gas line 6 is linked to the secondary line 7 by means of a sleeve which connects the interior of the line 6 to that of line 7 by means of holes 16. At regular intervals along line 7, plates 8 are fixed by welding or other suitable means. The plates 8 are at an angle of 85° to the axis of the line 7. Fuel outlet holes 9 in the lines 7 lie adjacent to the base of the plates 8. The outlet holes 9 are cut so as to direct at least a part of the fuel gas onto the surface of the plate 8. The cross-section of the outlet holes was circular or elliptical. FIG. 4(*b*) shows a radiant heat screen 15 of triangular cross-section which serves to protect the gas line 6 from direct flame impingement and recirculation of hot gases.

During use of the burner, at least part of the fuel gas emerging from outlet holes 9 impinges on plates 8 and spreads over the surface of the plates 8. This allows mixing of air and the fuel gas to provide a combustible mixture.

Experimental results for vertical fuel gas flow from the outlet holes showed that the optimum flame conditions were obtained for the plate angled towards the outlet holes by an angle of 4° to 7° from the vertical. At angles of greater than 7° from the vertical there was a tendency for turbulent air flow conditions to occur on the back of the plate which in certain cases could lead to the flame burning back down the plate which causes damage or disintegration of the plate.

The plate has its upper edge bent over to create a lip to prevent lift off of the flame and acts as a flame retainer. The to edge of the plate used in the experiments was bent over to an angle of up to 90°.

The upward flow of air past the outlet holes and plates was achieved by placing an enclosure or chimney around the burner so as to aspirate air upwardly through the burner. An alternative method of achieving this effect would be to use a fan or blower to force air upwardly through the burner.

FIG. 5 shows a vertical cross-section of a ground fired flare having a burner element according to the invention. The burner element 10 is positioned at the base of the flare chimney. The chimney comprises an inner refractory material 11, an insulating centre portion 12 and an outer metal skin 13. During operation of the flare, fuel gas is mixed with aspirated air from the chimney draught to produce, after ignition of the combustible mixture, flames stabilising above the plates 14 of the burner element 10.

I claim:

1. A burner comprising:

(a) a plurality of horizontally disposed fuel gas supply pipes;

(b) said supply pipes being streamlined to provide a relatively low resistance to upward air flow;

(c) each pipe having fuel gas outlets in the form of jets in the downstream face of the pipe;

(d) there being a plate adjacent to each jet, (e) the jets and plate being adapted to give an angle of fuel gas impingement on the plate of from 1° to 55° so as to mix the fuel gas and surrounding air on the plate;

(f) the plate also having means for flame retention; and (g) means for passing air upwardly past the jets and plates.

2. A burner according to claim 1 in which the fuel gas outlet is adapted so as to give vertical fuel gas flow.

3. A burner according to claim 1 in which the plate is inclined towards the outlet so as to make an angle of up to 10° from the vertical.

4. A burner according to claim 3 in which the plate is at an angle of 4° to 7° from the vertical.

5. A burner according to claim 1 in which the fuel outlet has a circular or eliptical cross-section.

6. A burner according to claim 1 in which the means for retaining the flame comprises the upper edge of the plate being inclined towards the fuel gas outlet.

7. A burner according to claim 1 which comprises a discrete plate associated with each fuel gas outlet.

8. A burner according to claim 1 comprising one or more elongate plates, each plate being associated with one or more fuel gas outlets.

9. A burner according to claim 1 comprising an array of fuel gas pipes.

10. A burner according to claim 9 in which the fuel gas pipes are arranged in parallel rows.

11. A burner according to claim 1 in which a radiant heat screen is positioned above the fuel supply pipe.

12. A burner according to claim 11 in which the radiant heat screen comprises a strip of metal of V-shaped cross-section.

13. A burner according to claim 1 in which the means for passing air upwardly past the outlets and plates comprises a vertical enclosure or chimney.

14. A burner according to claim 1 in which the means for passing air upwardly past the outlets and plates comprises an air blower or fan.

15. A ground flare comprising a supply pipe for fuel gas, the supply pipe being connected to a burner according to claim 1, and an enclosure having vertical walls, the lower ends of which are above ground level thereby allowing access of air to the burner element within the enclosure.

16. A ground flare according to claim 15 having a draught fence surrounding the base of the flare.

17. A burner comprising a fuel gas supply pipe being streamlined so as to present low resistance to upward air flow, the pipe having one or more outlets, a plate adjacent and at an angle to each outlet whereby the angle of fuel gas impingement on the plate is at an angle of 1° to 55°, means for passing air upwardly past the outlets and plates, and means for retaining the flame resulting from combustion of the fuel gas and air, said flame retaining means comprising the upper edge of the plate inclined into a horizontal position towards the fuel gas outlet.

* * * * *

UNITED STATES PATENT AND TRADEMARK OFFICE

CERTIFICATE OF CORRECTION

PATENT NO. : 4,493,638

DATED : JANUARY 15, 1985

INVENTOR(S) : ROGER S. SCAMMELL

It is certified that error appears in the above-identified patent and that said Letters Patent is hereby corrected as shown below:

Column 1, line 36, "plat" should be --plate--.

Column 2, line 12, "cause" should be --caused--.

Column 1, lines 59 and 60 "direct" should be --direction--.

Column 4, line 27 after "The" and before "edge" delete --to--.

Signed and Sealed this

*Ninth* Day of *July 1985*

[SEAL]

*Attest:*

DONALD J. QUIGG

*Attesting Officer* *Acting Commissioner of Patents and Trademarks*